US010344953B2

(12) United States Patent
Cordell et al.

(10) Patent No.: US 10,344,953 B2
(45) Date of Patent: Jul. 9, 2019

(54) APPARATUS AND METHOD TO SELF-ALIGN LED MODULES IN A LUMINAIRE AND SECURE WITH A SINGLE FIXATION POINT

(71) Applicant: Samsung Electronics Co., Ltd., Suwon-si, Gyeonggi-do (KR)

(72) Inventors: Michael W. Cordell, Loganville, GA (US); Yunseok Woo, Suwon-si (KR)

(73) Assignee: SAMSUNG ELECTRONICS CO., LTD. (KR)

( * ) Notice: Subject to any disclaimer, the term of this patent is extended or adjusted under 35 U.S.C. 154(b) by 149 days.

(21) Appl. No.: 15/353,736

(22) Filed: Nov. 16, 2016

(65) Prior Publication Data

US 2018/0135835 A1 May 17, 2018

(51) Int. Cl.

| | |
|---|---|
| ***F21V 17/16*** | (2006.01) |
| ***F21V 19/00*** | (2006.01) |
| ***F21Y 115/10*** | (2016.01) |

(52) U.S. Cl.

CPC ..... *F21V 17/16* (2013.01); *F21V 19/003* (2013.01); *F21Y 2115/10* (2016.08)

(58) Field of Classification Search

CPC ..... F21V 17/10; F21V 17/16; F21V 19/003; F21Y 2115/10; F21K 9/20

See application file for complete search history.

(56) References Cited

U.S. PATENT DOCUMENTS

| | | | | |
|---|---|---|---|---|
| 7,686,470 | B2 * | 3/2010 | Chiang | F21S 8/04 362/147 |
| 8,247,821 | B2 | 8/2012 | Liao | |
| 8,297,826 | B2 | 10/2012 | Murakoshi et al. | |
| 8,525,193 | B2 * | 9/2013 | Crandell | B32B 33/00 257/88 |
| 9,605,819 | B2 * | 3/2017 | Jiang | F21K 9/00 |
| 9,964,258 | B2 * | 5/2018 | Yanwei | F21K 9/237 |
| 2015/0109804 | A1 | 4/2015 | Parekh | |
| 2016/0124268 | A1 | 5/2016 | Ohtsuka et al. | |
| 2017/0122507 | A1 * | 5/2017 | Hoffman | F21S 4/22 |
| 2017/0254516 | A1 * | 9/2017 | Zhu | F21V 17/10 |
| 2018/0135835 | A1 * | 5/2018 | Cordell | F21V 17/16 |

FOREIGN PATENT DOCUMENTS

| | | |
|---|---|---|
| EP | 3032170 A1 | 6/2016 |

* cited by examiner

*Primary Examiner* — Peggy A Neils
(74) *Attorney, Agent, or Firm* — Renaissance IP Law Group LLP

(57) ABSTRACT

Systems, apparatus, and methods are disclosed for connecting a light-emitting diode (LED) module and a mounting structure such as a luminaire. The configuration enables the LED module to self-align while securing the module and luminaire with a single fixation point.

19 Claims, 2 Drawing Sheets

APPARATUS AND METHOD TO SELF-ALIGN LED MODULES IN A LUMINAIRE AND SECURE WITH A SINGLE FIXATION POINT

FIELD

The present disclosure relates to apparatus and methods to self-align a light-emitting diode (LED) module and a luminaire and to secure the module and luminaire with a single fixation point.

BACKGROUND

Most LED modules require multiple fasteners to mount the LED module in the fixture. This adds significant labor cost and increases the chance of damage during the assembly process. As the length of LED modules increases, it is necessary to increase the number of fasteners through the use of fasteners such as screw fasteners, plastic poke-in fasteners, and plastic mounting clips. Increasing the number of fasteners result in rising costs due to the increased number of fasteners and increased amount of time required for a laborer to mount the fasteners. Reduction in the number of fasteners may result in bowing of the LED module and poor thermal conduction.

Many methods have been tried to reduce the need for many fasteners. It is not practical to compensate for bowing through the use of adhesive tape, which does not offer high reliability and is affected by temperature. Embodiments disclosed herein solve these problems by requiring only a single fixed point, allowing thermal expansion of the LED module, and reducing the assembly time. Examples of prior art attempts to address these problems or relevant structures include those disclosed in EP3032170, U.S. Pat. No. 8,247,821, 8,297,826, U.S. Patent Application Publication No. US2016/0124268, and U.S. Patent Application Publication No. US2015/0109804.

SUMMARY

Embodiments are disclosed herein that simplify mounting of printed circuit board (PCB) with LEDs on a surface of a luminaire or a PCB mounting surface. Mounting is simplified by reducing the need to use multiple fixed points and minimizing the mounting requirements to a single fixed point.

The single fixed point also allows for thermal expansion of the LED module and thus eliminates bowing, which causes a loss of thermal conduction. Features of the stamped mounting tab and printed circuit design also improve the assembly speed and reliability.

Embodiments are disclosed that comprise a notched PCB. The notched PCB is used in combination with stamped metal mounting tabs. In one embodiment, the stamped metal tabs have a flared opening on one side that allows for easy insertion of the notched PCB while still providing proper force to the LED module. The mounting tabs hold the LED module down on the surface of the luminaire or another mounting structure but do not fix the location thus allowing for the thermal expansion and contraction of the LED modules. In one embodiment, the PCB design has mounting notches on each side of the PCB that are staggered with respect to each other. The configuration of the notches enables the mounting tabs to be positioned in the notches when the PCB and the mounting structure are in an initial position and also enables the PCB and the mounting structure to be moved relative to each other with portions of the sides of the PCB in the mounting tabs when the PCB and the mounting structure are in a mounted position.

The PCB design also has alignment tapers that automatically align the LED module into the mounted position between the mounting tabs. For LED modules that are relatively long, the mounting notches may be offset to allow one half to be partially inserted before inserting the second half. The PCB circuit design is such to prevent shorting by keeping power traces out of the mounting tab area.

In one embodiment, a light emitting diode module system comprises a printed circuit board having a longitudinal axis and a plurality of light emitting diodes positioned along the longitudinal axis of the printed circuit board. The printed circuit board has a first side that is opposing and parallel to a second side. The first side of the printed circuit board has a first mounting notch and the second side of the printed circuit board has a second mounting notch. The first mounting notch and the second mounting notch are staggered relative to each other along the longitudinal axis of the printed circuit board. Each mounting notch comprises a slot portion and an alignment portion. Each slot portion is defined by a step side and an inset side. Each step side is essentially perpendicular to the sides of the printed circuit board and extends from one side of the printed circuit board toward the other side of the printed circuit board to the inset side. Each inset side is essentially parallel to the sides of the printed circuit board. Each alignment portion is defined by an alignment ramp, which enables the printed circuit board to be aligned into a position between the first and second mounting tabs.

The system further comprises a mounting structure such a luminaire or a PCB mounting structure. The mounting structure has a first mounting tab and a second mounting tab that are fixedly positioned to respectively correspond with the first mounting notch and the second mounting notch.

Each mounting tab comprises a stem that is connected to a segment. Each stem is oriented away from the mounting structure. Each mounting notch has a width that permits it to receive its corresponding mounting tab when the printed circuit board is positioned on the mounting structure in an initial position. Each segment is offset from the mounting structure by a distance that enables the first side of the printed circuit board to be positioned between the segment of the first mounting tab and the mounting structure and the second side of the printed circuit board to be positioned between the segment of the second mounting tab and the mounting structure after the printed circuit board has been positioned in its mounted position such that the sides of the printed circuit board are constrained by the stems and segments of the mounting tabs.

The system further comprises a fixation device that prevents the printed circuit board from sliding relative to the first mounting tab and a second mounting tab.

BRIEF DESCRIPTION OF THE DRAWINGS

The written disclosure herein describes illustrative embodiments that are non-limiting and non-exhaustive. Reference is made to certain of such illustrative embodiments that are depicted in the figures, as listed below.

DETAILED DESCRIPTION OF THE PREFERRED EMBODIMENTS

Various exemplary embodiments will be described more fully hereinafter with reference to the accompanying drawings. The present inventive concept may, however, be embodied in many alternate forms and should not be construed as limited to the example embodiments set forth herein. Rather, these example embodiments are provided so that this description will be thorough and complete, and will fully convey the scope of the present inventive concept to those skilled in the art.

Embodiments are disclosed that comprise a notched PCB. The notched PCB is used in combination with stamped metal mounting tabs. Some of the benefits of the disclosed embodiments include simplifying LED luminaire assembly, reducing the number of fixation points, reducing bowing of LED modules due to thermal expansion, enabling self-alignment of a LED module during insertion, reducing LED luminaire assembly time, and reduces LED module damage during luminaire assembly.

Figure 1:
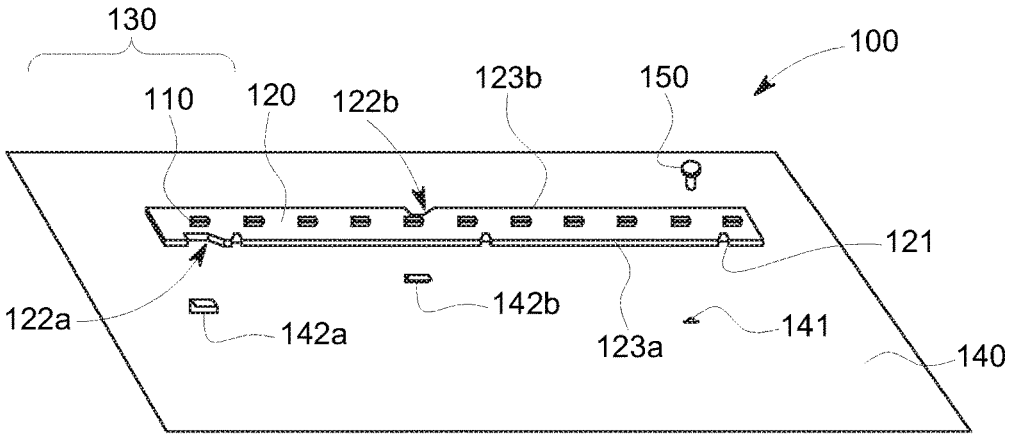
FIG. 1 is a perspective view of a LED module system including a LED module being assembled on a PCB mounting structure.

FIG. 1 is a perspective view of a LED module system 100. The system includes a plurality of LEDs, which are identified at 110. The LEDs are mounted on a PCB 120. More particularly, the LEDs 110 are mounted along the longitudinal axis of PCB 120. LEDs 110 and PCB 120 comprise a LED module 130. PCB 120 is mounted on a surface of a luminaire 140 or a PCB mounting structure 140.

PCB 120 has at least one void such as recess 121 and at least two mounting notches 122. The mounting notches 122*a-b* are on the opposing sides 123*a-b* of the PCB 120. More particularly, the mounting notches 122*a-b* are at sides 123*a-b* and are staggered relative to each other along the longitudinal axis of PCB 120.

In addition to recesses 121 in sides 123*a-b* of PCB 120, the voids may be holes that are inset from sides 123*a-b*. The alignment of voids 121 with holes 141 in PCB mounting structure 130 is discussed below with reference to FIGS. 3A-3C.

The mounting structure 140 has at least two mounting tabs such as first and second mounting tabs 142*a-b*, which are fixedly positioned to respectively correspond with the first and second mounting notches 122*a-b*. Each mounting notch 122 has a width that permits it to receive its corresponding mounting tab 142*a-b* when the printed circuit board 120 is positioned on the mounting structure 140 in an initial position. Stated otherwise, each notch 122*a-b* has a configuration that permits each notch to be positioned over the respective mounting tab 142*a-b* in an initial position. The unique configuration of the notches 122*a-b* permits the LED module to pass over rows of mounting tabs for initial positioning.

Figure 2A:
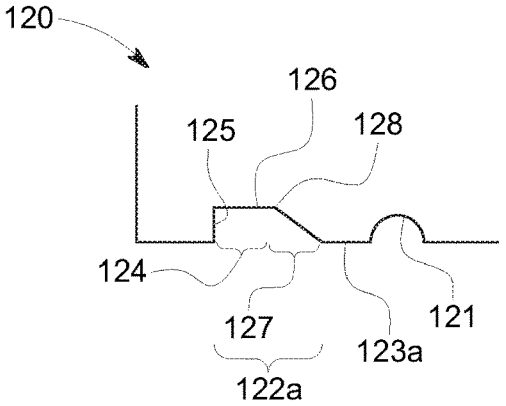
FIG. 2A is an enlarged plan view of the lower left corner of the PCB shown in FIG. 1 showing the details of a notch including its slot portion and alignment portion.

FIG. 2A is an enlarged plan view of the lower left corner of PCB shown in FIG. 1 depicting the details of notch 122*a*. Notch 122*b* has a mirror image configuration with respect to notch 122*a*. Each notch 122 has a slot portion and an alignment portion. The slot portion 124 is defined by a step side 125 and an inset side 126. Step side 125 is essentially perpendicular to the sides 123*a-b* and extends from first side 123*a* of the printed circuit board 120 toward the second side 123*b* of the printed circuit board to the inset side 126. Inset side 126 is essentially parallel to side 123. Alignment portion 127 includes an alignment ramp 128. The alignment ramp 128 is a section of the PCB that tapers in width relative to the distance between the two opposing sides 123*a-b* of the PCB 120 and the distance between the inset side 126 and the opposing side 123*b* of the PCB. Each of the alignment ramps 128 enable the PCB 120 to be automatically aligned into the proper position between the mounting tabs 142*a-b*.

Figure 2B:
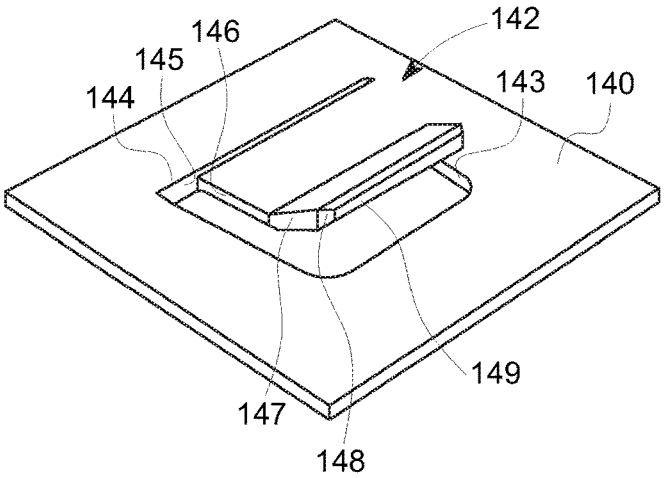
FIG. 2B is a perspective view of a mounting tab extending from a PCB mounting structure.

FIG. 2B depicts an enlarged portion of the PCB mounting structure 140 that has a mounting tab 142. Mounting tab 142 is located at an opening 143 formed by separating three sides of a portion of PCB mounting structure 140 from its surrounding portions of the PCB mounting structure 140. The separation of a portion of PCB mounting structure 140 yields mounting tab 142. Mounting tab 142 is shown including a stem 144, a first bend 145, a segment 146, a second bend 147, a guide 148, and an end 149. Stem 144 is oriented away from mounting structure 140. More particularly, stem 144 is angled with respect to PCB mounting structure 140 such that segment 146 is offset from PCB mounting structure 140. Because the stem 144 is oriented away from the mounting structure with an acute angle and the first bend 145 is an obtuse angle between the stem 144 and the segment 146, the segment 146 is essentially parallel with the mounting structure 140. This parallel orientation of the segment 146 enables the mounting tabs 142*a-b* to constrain the sides 123*a-b* because the offset between the segment 146 and the mounting structure 140 is essentially the same as the height of the PCB 120. Stated more precisely, the segment 146 is offset from the mounting structure 140 by a distance that enables the first side 123*a* of the printed circuit board 120 to be positioned between the segment 146 of the first mounting tab 142*a* and the mounting structure 140 and the second side 123*b* of the printed circuit board 120 to be positioned between the segment 146 of the second mounting tab 142*b* and the mounting structure 140 after the printed circuit board 120 has been positioned in its mounted position such that the sides 123*a-b* of the printed circuit board 120 are constrained by the stems 144 and segments 146 of the mounting tabs.

Optionally, a mounting tab may include a guide 148, as shown, extending from a second bend 147. The guide 148 terminates at end 149. In another embodiment without a guide extending from a segment, the segment terminates at an end like end 149. The guide 148 is angled with respect to the segment 146 at a second bend 147 in a direction away from the mounting structure 140 such that the guide 148 is angled upward relative to the mounting structure 140.

Mounting tab 142 is stamped from the metal of the PCB mounting structure. Mounting tab 142 has a flared opening on one side that allows for easy insertion of the PCB 120 while still providing proper force to the LED module 130, particularly PCB 120. The mounting tabs 142 hold the LED module down on the surface of the luminaire 140 but do not fix the location thus allowing for the thermal expansion and contraction of the LED modules. Mounting notches 122 enable the PCB 120 to be positioned on the PCB mounting structure 140 with mounting notches 122 between mounting tabs 142 that are on opposing sides of the PCB 120 and in staggered positions. After alignment of the mounting notches 122 in the mounting tabs 142 then the PCB 120 may be slid into place through the use of the alignment ramp 128. Alignment ramps 128 are sections of the PCB that taper in width between 126 and the opposing side between the alignment portion that tapers that automatically align the LED module into the proper position between the mounting tabs. On very long LED modules the mounting notches are offset to allow one half to be partially inserted before inserting the second half. The PCB circuit design is such to prevent shorting by keeping power traces out of the mounting tab area.

Notches 122 provide for self-alignment of the LED module between the rows of mounting tabs 142. This feature greatly speeds up the installation of the LED module in the product and insures proper placement of the module.

Figure 3A:
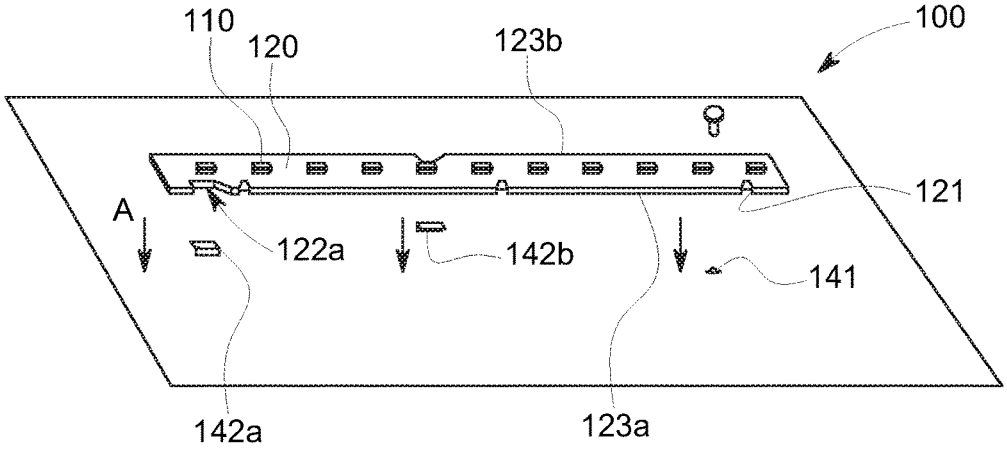
FIG. 3A is a perspective view of a LED module with a PCB and a plurality of LEDs above a PCB mounting structure that features multiple mounting tabs.

As shown in FIG. 3A, the installation process begins by placing the LED module 130 over the mounting tabs 142 utilizing the unique notches 122 until the LED module 130 is flat with the surface of the PCB mounting structure 140.

Figure 3B:
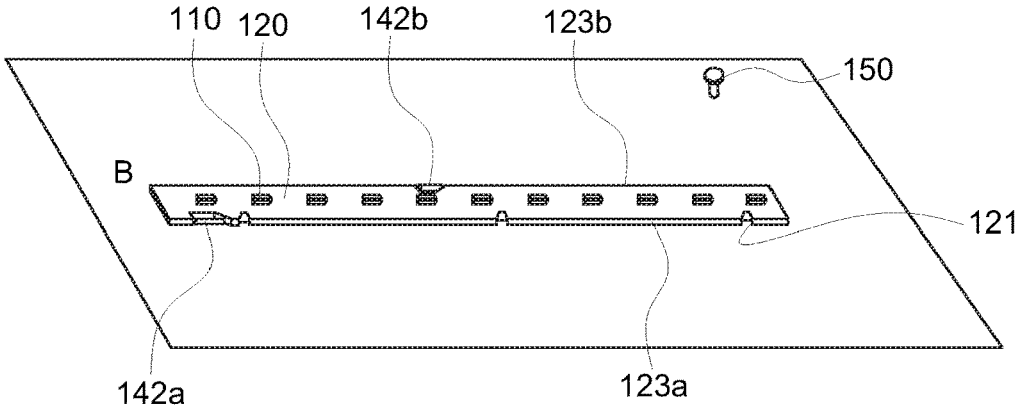
FIG. 3B is a perspective view of a LED module with the notches of the PCB aligned in mounting tabs of the PCB mounting structure.

FIG. 3B shows the LED module 130 sliding into place as the self-aligning configuration of notches 122 positions the module 130 between the mounting tabs 142.

Figure 3C:
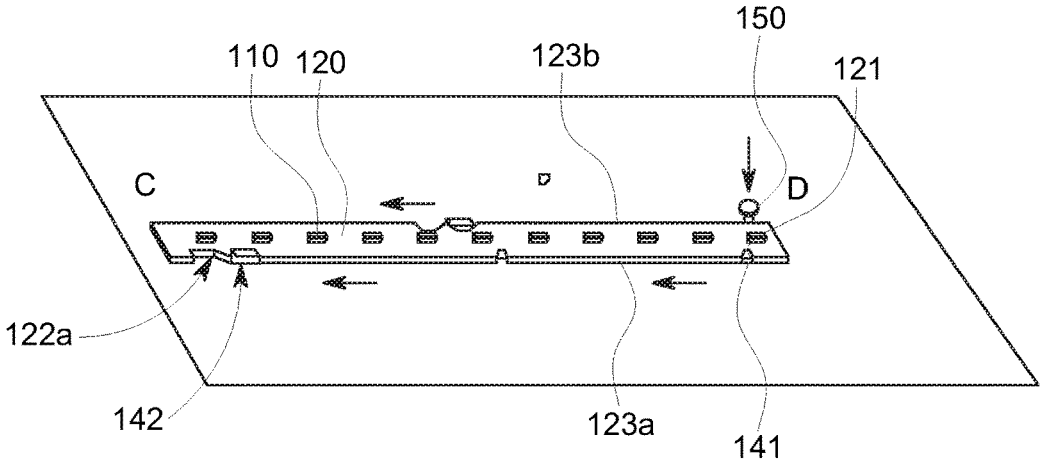
FIG. 3C is a perspective view of a LED module system after the PCB has been slid relative to the mounting tabs to lock the PCB into place on the PCB mounting structure.

As shown in FIG. 3C, once the module is in its final position, a single point fixation device, like a screw, push pin, spring clip, or metal stamping 150 can be inserted in mounting hole 141 via recess 121 to prevent the LED module from sliding out from under the mounting tabs 142. Stated otherwise, the PCB 120 has at least one void that is configured to cooperate with a fixation device that prevents the PCB 120 from sliding relative to the first and second mounting tabs 142*a-b*.

Any methods disclosed herein comprise one or more steps or actions for performing the described method. The method steps and/or actions may be interchanged with one another. In other words, unless a specific order of steps or actions is required for proper operation of the embodiment, the order and/or use of specific steps and/or actions may be modified. Recitation in the claims of the term "first" with respect to a feature or element does not necessarily imply the existence of a second or additional such feature or element.

References to approximations are made throughout this specification, such as by use of the terms "about" or "approximately." For each such reference, it is to be understood that, in some embodiments, the value, feature, or characteristic may be specified without approximation. For example, where qualifiers such as "about," "substantially," and "generally" are used, these terms include within their scope the qualified words in the absence of their qualifiers.

Reference throughout this specification to "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, as the following claims reflect, inventive aspects lie in a combination of fewer than all features of any single foregoing disclosed embodiment.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description. These additional embodiments are determined by replacing the dependency of a given dependent claim with the phrase "any of the preceding claims up to and including claim [x]," where the bracketed term "[x]" is replaced with the number of the most recently recited independent claim. For example, for the first claim set that begins with independent claim 1, claim 3 can depend from either of claims 1 and 2, with these separate dependencies yielding two distinct embodiments; claim 4 can depend from any one of claim 1, 2, or 3, with these separate dependencies yielding three distinct embodiments; claim 5 can depend from any one of claim 1, 2, 3, or 4, with these separate dependencies yielding four distinct embodiments; and so on.

Embodiments of the invention in which an exclusive property or privilege is claimed are defined as follows.

The invention claimed is:

1. A light emitting diode module system comprising:
a printed circuit board having a longitudinal axis; and
a plurality of light emitting diodes positioned along the longitudinal axis of the printed circuit board;
wherein the printed circuit board has a first side that is opposing and parallel to a second side,
wherein the first side of the printed circuit board has a first mounting notch,
wherein the second side of the printed circuit board has a second mounting notch,
wherein the first mounting notch and the second mounting notch are staggered relative to each other along the longitudinal axis of the printed circuit board;
wherein each mounting notch comprises a slot portion and an alignment portion,
wherein each slot portion is defined by a step side and an inset side,
wherein each step side is essentially perpendicular to the sides of the printed circuit board and extends from one side of the printed circuit board toward the other side of the printed circuit board to the inset side,
wherein each inset side is essentially parallel to the sides of the printed circuit board, and
wherein each alignment portion is defined by an alignment ramp extending at a non-perpendicular angle from one of the sides of the printed circuit board to the inset side.

2. The system of claim 1, wherein each alignment ramp extends between an inset side and one of the sides of the printed circuit board, wherein the alignment ramp is a section of the printed circuit board that tapers in width relative to a distance between the first and second sides of the printed circuit board and a distance between the inset side and the opposing side of the printed circuit board.

3. The system of claim 1, further comprising a mounting structure having a first mounting tab and a second mounting tab that are fixedly positioned to respectively correspond with the first mounting notch and the second mounting notch.

4. The system of claim 3, wherein each mounting tab comprises a stem that is connected to a segment, wherein the stem is oriented away from the mounting structure, and wherein the segment is offset from the mounting structure by a distance that enables one of the sides of the printed circuit board to be positioned between the segment of the mounting tab and the mounting structure.

5. The system of claim 4, wherein the segment is essentially parallel with the mounting structure.

6. The system of claim 4, wherein each mounting tab further comprises a guide that is connected to the segment, wherein the guide terminates at an end, and wherein the guide is angled with respect to the segment at a second bend in a direction away from the mounting structure such that the guide is angled upward relative to the mounting structure.

7. The system of claim 3, further comprising a fixation device that prevents the printed circuit board from sliding relative to the first mounting tab and a second mounting tab.

8. The system of claim 1, wherein the printed circuit board has at least one void that is configured to cooperate with a fixation device.

9. A light emitting diode module system comprising:

a printed circuit board having a longitudinal axis, wherein the printed circuit board has a first side that is opposing and parallel to a second side, wherein the first side of the printed circuit board has a first mounting notch, wherein the second side of the printed circuit board has a second mounting notch, and wherein the first mounting notch and the second mounting notch are staggered relative to each other along the longitudinal axis of the printed circuit board;

a plurality of light emitting diodes positioned along the longitudinal axis of the printed circuit board;

a mounting structure having a first mounting tab and a second mounting tab that are fixedly positioned to respectively correspond with the first mounting notch and the second mounting notch; and a fixation device that prevents the printed circuit board from sliding relative to the first mounting tab and the second mounting tab; and wherein each mounting notch comprises a slot portion that is defined by a step side and an inset side, wherein each step side is essentially perpendicular to the sides of the printed circuit board and extends from one side of the printed circuit board toward the other side of the printed circuit board to the inset side, and wherein each inset side is essentially parallel to the sides of the printed circuit board.

10. The system of claim 9, wherein each mounting notch further comprises an alignment portion.

11. The system of claim 10, wherein the alignment portion is defined by an alignment ramp, which enables the printed circuit board to be aligned into a position between the first and second mounting tabs.

12. The system of claim 11, wherein the alignment ramp extends between an inset side and one of the sides of the printed circuit board, wherein the alignment ramp is a section of the printed circuit board that tapers in width relative to a distance between the first and second sides of the printed circuit board and a distance between the inset side and the opposing side of the printed circuit board.

13. The system of claim 9, wherein each mounting tab comprises a stem that is connected to a segment, wherein the stem is oriented away from the mounting structure, and wherein the segment is offset from the mounting structure by a distance that enables one of the sides of the printed circuit board to be positioned between the segment of the mounting tab and the mounting structure.

14. The system of claim 13, wherein the segment is essentially parallel with the mounting structure.

15. The system of claim 13, wherein each mounting tab further comprises a guide that is connected to the segment, wherein the guide terminates at an end, and wherein the guide is angled with respect to the segment at a second bend in a direction away from the mounting structure such that the guide is angled upward relative to the mounting structure.

16. The system of claim 9, wherein the fixation device includes a spring clip or metal stamping.

17. The system of claim 9, wherein the printed circuit board has at least one void that is configured to cooperate with the fixation device; and wherein the mounting structure has at least one void that is configured to cooperate with the fixation device.

18. A light emitting diode module system comprising:

a printed circuit board having a longitudinal axis, wherein the printed circuit board has a first side that is opposing and parallel to a second side, wherein the first side of the printed circuit board has a first mounting notch, wherein the second side of the printed circuit board has a second mounting notch, and wherein the first mounting notch and the second mounting notch are staggered relative to each other along the longitudinal axis of the printed circuit board;

a plurality of light emitting diodes positioned along the longitudinal axis of the printed circuit board;

a mounting structure having a first mounting tab and a second mounting tab that are fixedly positioned to respectively correspond with the first mounting notch and the second mounting notch; and a fixation device that prevents the printed circuit board from sliding relative to the first mounting tab and a second mounting tab;

wherein each mounting tab comprises a stem that is connected to a segment, wherein each stem is oriented away from the mounting structure, wherein each mounting notch has a width that permits it to receive its corresponding mounting tab when the printed circuit board is positioned on the mounting structure in an initial position, and wherein each segment is offset from the mounting structure by a distance that enables the first side of the printed circuit board to be positioned between the segment of the first mounting tab and the mounting structure and the second side of the printed circuit board to be positioned between the segment of the second mounting tab and the mounting structure after the printed circuit board has been positioned in its mounted position such that the sides of the printed circuit board are constrained by the stems and segments of the mounting tabs.

19. The system of claim 18, wherein each mounting notch comprises a slot portion and an alignment portion.

* * * * *